US010874203B2

(12) United States Patent
Crapet et al.

(10) Patent No.: US 10,874,203 B2
(45) Date of Patent: Dec. 29, 2020

(54) APPLICATOR FOR COSMETIC PRODUCT AND APPLICATOR ASSEMBLY COMPRISING SUCH AN APPLICATOR

(71) Applicant: ALBEA SERVICES, Gennevilliers (FR)

(72) Inventors: Yann Crapet, Fremecourt (FR); Camille Schreiber, Paris (FR)

(73) Assignee: ALBEA SERVICES, Gennevilliers (FR)

( * ) Notice: Subject to any disclaimer, the term of this patent is extended or adjusted under 35 U.S.C. 154(b) by 69 days.

(21) Appl. No.: 15/639,108

(22) Filed: Jun. 30, 2017

(65) Prior Publication Data

US 2018/0000228 A1 Jan. 4, 2018

(30) Foreign Application Priority Data

Jun. 30, 2016 (FR) ..... 16 56243

(51) Int. Cl.
*A46B 7/02* (2006.01)
*A46B 9/02* (2006.01)
*A45D 40/26* (2006.01)

(52) U.S. Cl.
CPC ..... *A46B 7/02* (2013.01); *A46B 9/021* (2013.01); *A46B 9/026* (2013.01); *A45D 40/267* (2013.01); *A46B 2200/1053* (2013.01)

(58) Field of Classification Search
CPC ..... A45D 40/626; A45D 40/625; A46B 7/02; A46B 2200/1053; A46B 9/021
See application file for complete search history.

(56) References Cited

U.S. PATENT DOCUMENTS 8,191,559 B2 * 6/2012 Bickford ..... A45D 34/045 132/218
D682,556 S 5/2013 Uresti et al.
8,689,808 B2 * 4/2014 Gueret ..... A45D 40/267 132/218
8,783,989 B2 * 7/2014 Weigel ..... A45D 40/24 132/218

(Continued)

FOREIGN PATENT DOCUMENTS

FR 3018436 9/2015
WO WO-9629905 A1 * 10/1996 ..... A45D 40/265
WO WO-2014174423 A1 * 10/2014 ..... A46B 9/021

OTHER PUBLICATIONS

Definition of "collinear." Retrieved from Dictionary.com. (Year: 2019).*

*Primary Examiner* — Erin Deery
(74) *Attorney, Agent, or Firm* — Steven M. Greenberg, Esq.; Shutts & Bowen LLP

(57) ABSTRACT

An applicator for cosmetic product is disclosed, in particular for mascara, extending in a main longitudinal extension direction, referred to as the main direction, between a proximal end and a distal end opposite the proximal end. The applicator includes a structural support element, referred to as a support, and at least one branch. The support and the branch are interconnected by means of an articulation rigidly connected to the support. The support and the branch extend in the main direction, and the support, the branch and the articulation allow a flexibility of the branch in more than one direction from an orthonormal reference point (X, Y, Z) attached to the applicator.

8 Claims, 7 Drawing Sheets

(56) References Cited

U.S. PATENT DOCUMENTS

| | | | |
|---|---|---|---|
| 2002/0014250 | A1 | 2/2002 | Gueret |
| 2007/0017544 | A1 | 1/2007 | Oreal |
| 2012/0199158 | A1 | 8/2012 | Bickford |
| 2013/0319451 | A1 | 12/2013 | Viegas |
| 2015/0216286 | A1 | 8/2015 | Wolfsgruber |

* cited by examiner

APPLICATOR FOR COSMETIC PRODUCT AND APPLICATOR ASSEMBLY COMPRISING SUCH AN APPLICATOR

CROSS REFERENCE TO RELATED APPLICATIONS

This application claims priority under 35 U.S.C. § 119(a) to French Patent Application Serial Number 1656243, filed Jun. 30, 2016, the entire teachings of which are incorporated herein by reference.

BACKGROUND OF THE INVENTION

Field of the Invention

The invention relates to an applicator for cosmetic product and to an applicator assembly that includes such an applicator.

Description of the Related Art

It is known to provide applicators for cosmetic product which are moulded, in particular from plastics material. These applicators are commonly referred to as "plastics brushes".

The constraints of molding for obtaining plastics brushes of this type lead to the provision of brushes having relatively rigid cores and bearing substantially flexible protrusions, the aim of this combination being to obtain advantageous effects in terms of make-up application.

SUMMARY OF THE INVENTION

One of the objects of the invention consists in proposing an alternative solution, in particular to known moulded applicators, which makes it possible to obtain equally satisfactory effects in terms of make-up application.

Thus, the invention relates to an applicator for cosmetic product, in particular for mascara, extending in a main longitudinal extension direction, referred to as the main direction, between a proximal end and a distal end opposite the proximal end in the main direction, the applicator comprising a structural support element, referred to as a support, and at least one branch, the support and the branch being interconnected by means of an articulation, the articulation being rigidly connected to the support.

According to the invention, the support and the branch extend in the main direction, and the support, the branch and the articulation are designed so as to allow a flexibility of the branch in more than one direction from an orthonormal reference point attached to the applicator, the applicator further comprising a plurality of protrusions projecting from the branch.

The applicator of the invention includes a branch which has a flexibility in more than one direction from an orthonormal reference point attached to the applicator. The branch is used to support a plurality of protrusions. Thus, the flexibility of the applicator no longer has to be sought in the design of the protrusions. This flexibility is obtained by means of the flexibility given to the branch supporting the protrusions.

The applicator of the invention thus proposes an alternative solution, in particular to known moulded applicators, which makes it possible to obtain equally satisfactory effects in terms of make-up application.

According to different embodiments of the invention, which can be taken together or separately:

- the articulation is produced from material of the support,
- the articulation is located in the main direction, between the proximal and distal ends of the applicator,
- the proximal and distal ends of the applicator are remote from one another by a length L, the articulation being remote by a length l with respect to the proximal end of the applicator, the lengths L and l being measured in the main direction, the lengths complying with the following ratio: $0.25 \leq l/L \leq 0.75$,
- the support is produced in the form of a hollow arch formed by a plurality of arms which connect the proximal and distal ends of the applicator, the arms being link arms, the articulation being supported by the link arms,
- the applicator of the invention includes three link arms which alternate in the main direction with a plurality of branches, in particular three, the branches all being connected to the articulation,
- the applicator of the invention further includes a plurality of protrusions which project from each of the link arms and each of the branches in the form of rows of protrusions arranged along the main direction,
- the branches are interconnected by means of reinforcing elements, referred to as plates, which are oriented substantially transversely to the main direction, there being two of the plates, each positioned in the vicinity of one of the proximal and distal ends of the applicator, the plates being designed so as not to hit the link arms when the flexibility of at least one of the branches is activated by an element outside the applicator,
- the support is produced in the form of a solid core,
- the applicator of the invention further includes a plurality of branches all connected to the articulation,
- the applicator of the invention includes a number of branches which is between 4 and 10, the branches each extending between the proximal and distal ends of the applicator,
- the applicator of the invention includes a number of branches which is between 8 and 20, the branches each extending, in the main direction, between the articulation and one or the other of the proximal or distal ends,
- the applicator of the invention further includes a plurality of protrusions which project from each of the branches in the form of rows of protrusions arranged along the main direction.

The invention also relates to an applicator assembly comprising an applicator of the type described above. The assembly further includes a bottle which is intended to receive a cosmetic product, the assembly being intended to occupy two positions, a first position, referred to as the position of use, in which a user can apply make-up with the applicator, and a second position, referred to as the rest position, in which the applicator is positioned inside the bottle, the assembly further comprising a wiper which is intended to be assembled with the bottle so as to wipe the applicator during the passage thereof from the rest position to the position of use.

According to different embodiments of the invention, which can be taken together or separately:

- the applicator further includes, in the vicinity of the distal end thereof, a protection region which is formed integrally with the support, the protection region being designed so as to avoid any removal of the at least one branch during the passage of the applicator assembly from the position of use to the rest position, the branches of the applicator are designed so as to converge towards the main direction when in contact with the wiper, so as to avoid any removal of the branches during the passage of the applicator assembly from the position of use to the rest position and/or from the rest position to the position of use.

BRIEF DESCRIPTION OF THE DRAWINGS

The invention will be better understood, and other aims, details, features and advantages thereof will become clearer throughout the following detailed explanatory description of at least one embodiment of the invention given by way of purely illustrative and non-limiting example, with reference to the accompanying schematic drawings.

DETAILED DESCRIPTION OF THE PREFERRED EMBODIMENTS

Figure 1:
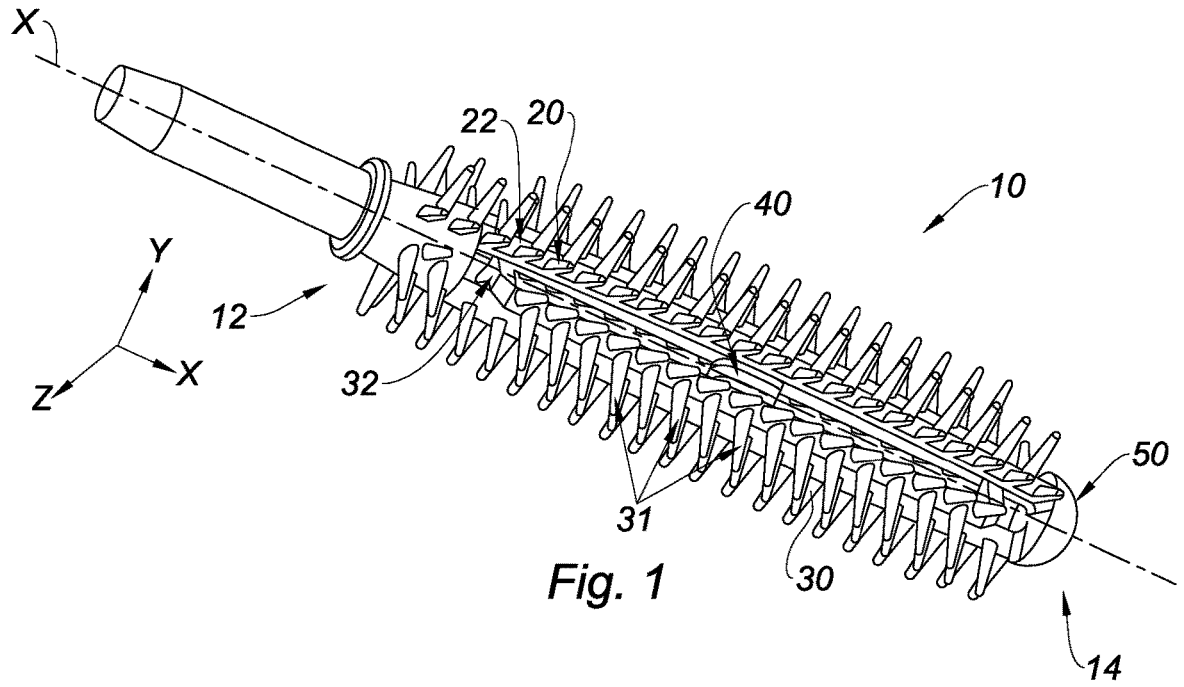
FIG. 1 is an isometric, slightly tilted view of a first embodiment of an applicator according to the invention.

The invention relates to an applicator 10 for cosmetic product, in particular for mascara, which extends in a main longitudinal extension direction, which is referred to as the main direction and labelled X in the drawings.

The applicator of the invention extends, between a proximal end 12 and a distal end 14 opposite the proximal end 12, in the main direction X.

The applicator advantageously includes a structural support element, referred to as a support 20, and at least one branch 30, the support 20 and the branch 30 being interconnected by means of an articulation 40, the articulation being rigidly connected to the support 20.

According to the invention, the support 20 and the branch 30 extend in the main direction X, and the support 20, the branch 30 and the articulation 40 are designed so as to allow a flexibility of the branch 30 in more than one direction from an orthonormal reference point (X, Y, Z) attached to the applicator 10, the applicator 10 further comprising a plurality of protrusions 31 projecting from the branch 30.

The support 20 and the branch 30 extend in the main direction X" is understood to mean that the support 20 and the branch 30 are collinear, extending around or in the main direction X. Thus, the support 20 and the branch 30 will extend in directions which are all in parallel with the main direction X.

Advantageously, the branch 30 projects from the articulation following a gradient which forms an angle which is substantially zero with respect to the main direction X.

Figure 4:
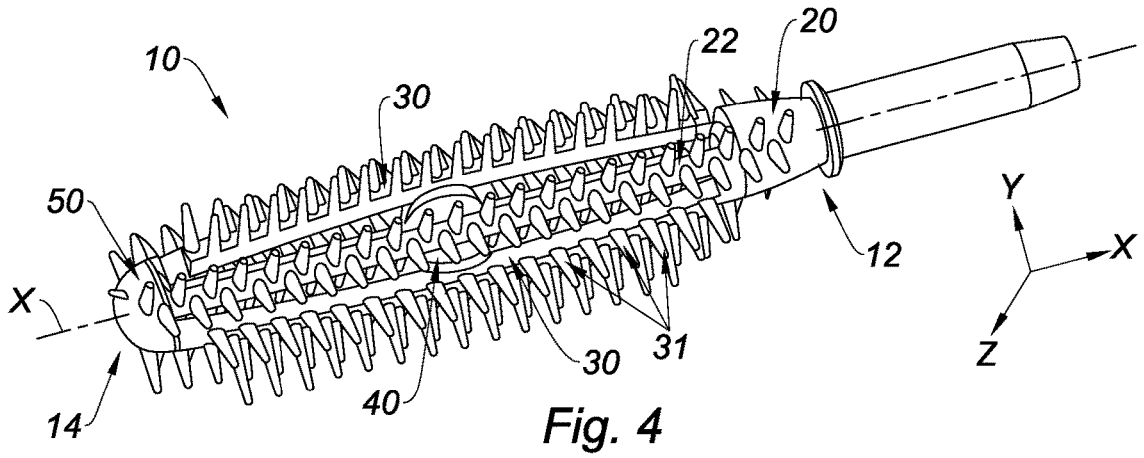
FIG. 4 is an isometric, slightly tilted view of a second embodiment of an applicator according to the invention.
Figure 7:
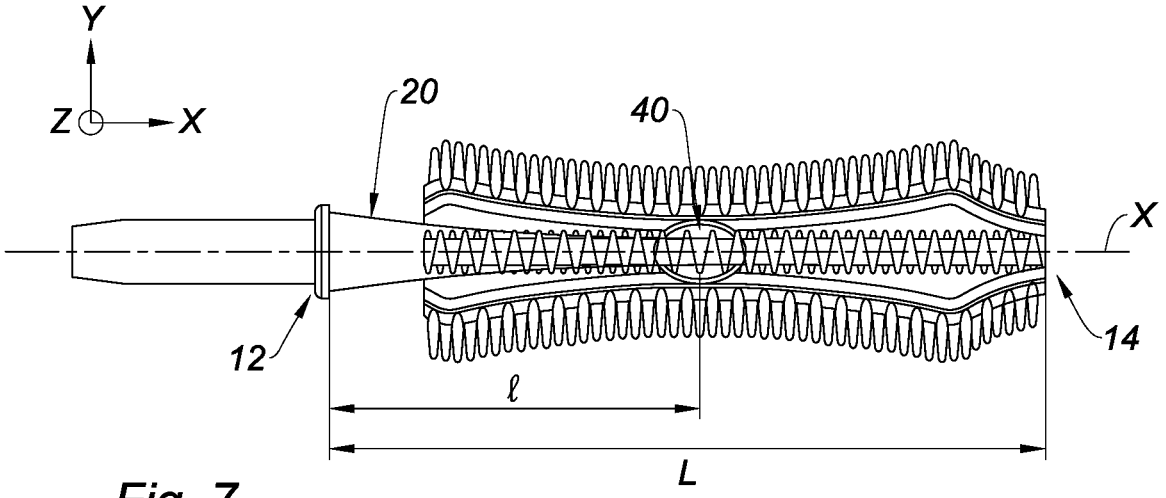
FIG. 7 is an isometric view of a third embodiment of an applicator according to the invention.
Figure 8:
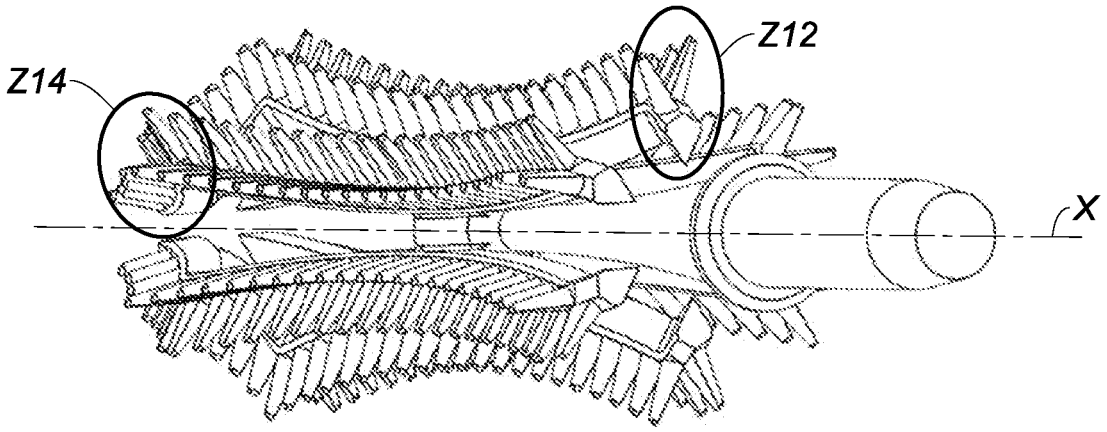
FIG. 8 is an isometric view of the same embodiment as that shown in FIG. 7, which is tilted and viewed so as to show in particular the proximal end of the applicator.
Figure 9:
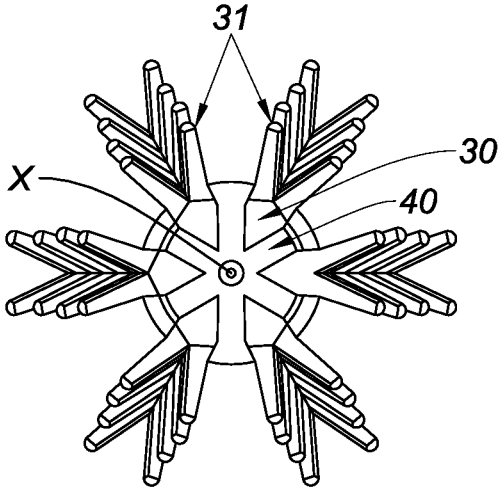
FIG. 9 is a plan view of the same embodiment as that shown in FIGS. 7 and 8, FIGS. 10 and 11 are cross-sectional views of the same embodiment as that shown in FIGS. 7 to 9, FIG. 11 being a cross-sectional view of FIG. 10, along the axis A-A which is labelled therein.
Figure 10:
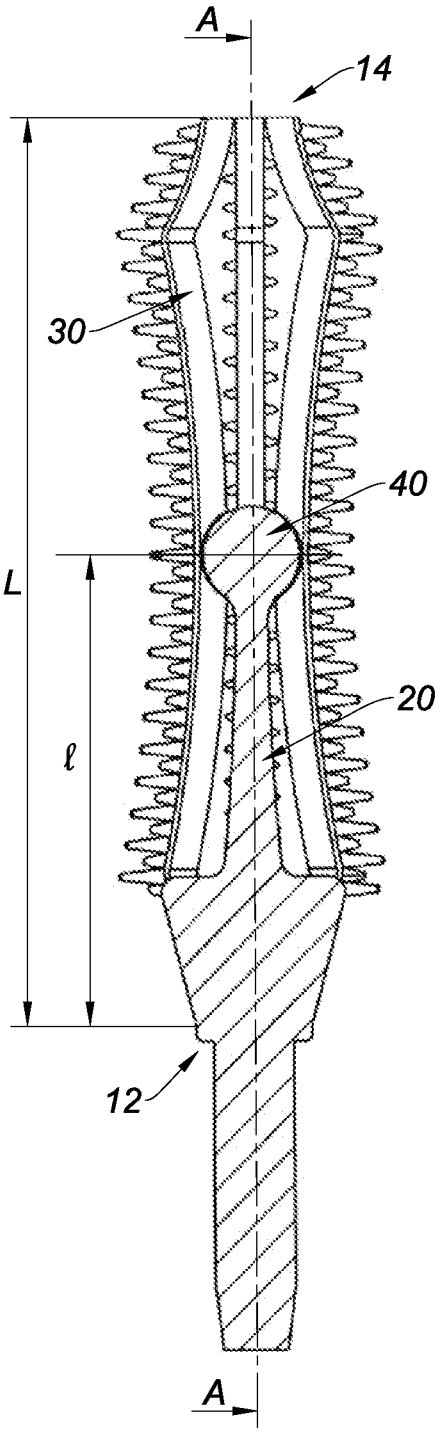
Figure 11:
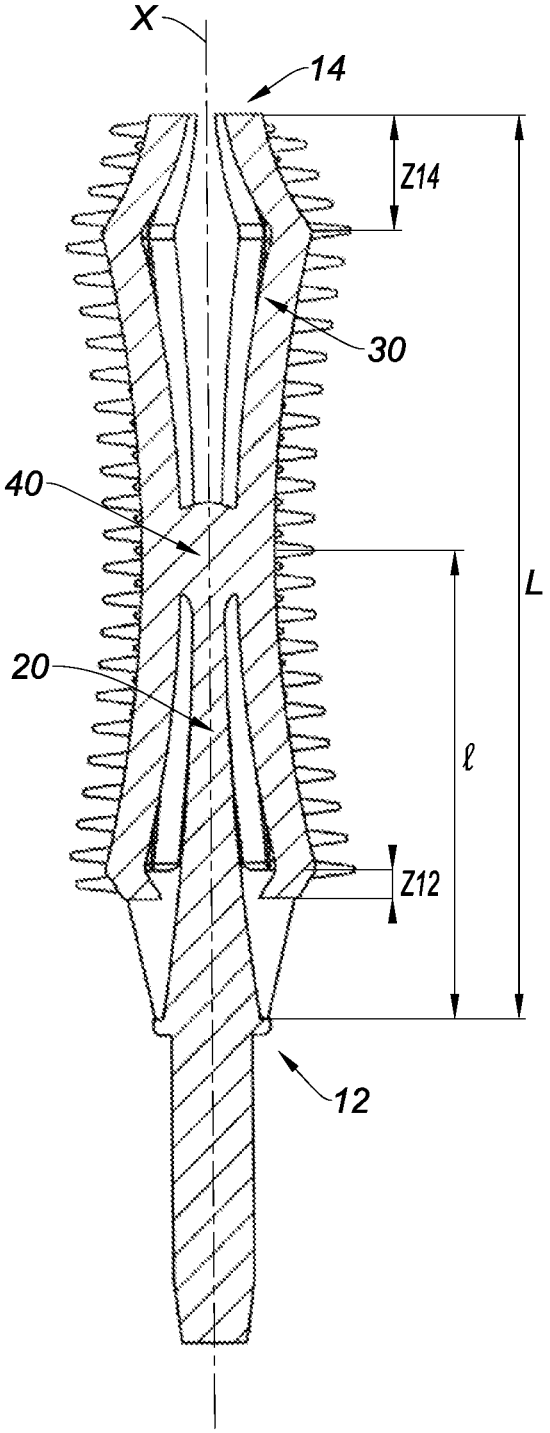

"Flexibility of the branch 30 in more than one direction from an orthonormal reference point (X, Y, Z) attached to the applicator 10" is understood to mean a potential movement of the branch 30 when the branch is touched by an external element, for example by a user's finger, or even by a user's fringe of eyelashes. The orthonormal reference point (X, Y, Z) is illustrated in FIGS. 1, 4 and 7, in relation to each of the three embodiments which will be described in detail in the following. This feature is also understood to mean a possibility for the branch 30 to move in a plurality of directions in space by carrying out a movement which is particularly visible at the end of the branch 30, i.e. in the vicinity of the proximal 12 and/or distal 14 ends of the applicator 10.

The articulation 40 will advantageously be produced from material of the support 20.

In this case, the articulation 40 is in the form of a solid ball. It is a connection region, or intermediate region, between the support 20 and the branches 30.

Secondly, the articulation 40 will be located, in the main direction X, between the proximal 12 and distal 14 ends of the applicator 10, which ends are remote by a length L (see FIGS. 3, 6, 7, 10 and 11) in the main direction X. By way of example, the length L will be between 25 and 35 mm; and will preferably be approximately 28 mm.

The articulation 40 will advantageously be remote by a length l with respect to the proximal end 12 of the applicator 10 in the main direction X.

The lengths will advantageously comply with the following ratio: $0.25 \leq l/L \leq 0.75$, and preferably the ratio $l=L/2$.

In other words, the articulation will be at a distance from at least one of the proximal 12 or distal 14 ends of the applicator 10, or even from the two, proximal 12 and distal 14 ends of the applicator 10.

According to a first and a second embodiment, illustrated by FIGS. 1 to 6, the support 20 will advantageously be produced in the form of a hollow arch formed by a plurality of arms 22 which connect the proximal 12 and distal 14 ends of the applicator 10, the arms 22 being link arms, the articulation 40 then being supported by the link arms 22.

A "hollow arch" is understood to mean a support 20 which is in the form of a hollow core, or also of a structure supported by support beams—the link arms 22—between the proximal 12 and distal 14 ends.

In the context of the first and second embodiments shown here, the applicator 10 of the invention includes three link arms 22 which alternate around the main direction X with a plurality of branches 30, in particular three, the branches 30 all being connected to the articulation 40. The link arms 22 have a length, in the main direction X, which is greater than that of the branches 30, the branches also being measured in the main direction X.

In other words, the link arms 22 and the branches 30 each extend in their own direction which is collinear with the main direction X. In other words again, the link arms 22 and the branches 30 each extend in a direction which is distinct from the link arm 22 which is directly adjacent thereto and/or from the branch 30 which is directly adjacent thereto.

Secondly, the applicator 10 of the invention includes a plurality of protrusions 21, 31 which project, respectively, from each of the link arms 22 and each of the branches 30 in the form of rows of protrusions 21, 31 arranged along the main direction X (see FIGS. 1, 2, 4 and 5). The protrusions 21, 31 will advantageously project on both sides of a plane which is substantially orthogonal to the main direction X. The protrusions 21, 31 will form on each of the link arms 22, and on each of the branches 30, a row of teeth distributed in staggered rows, on both sides of the plane which is substantially orthogonal to the main direction X.

Figure 2:
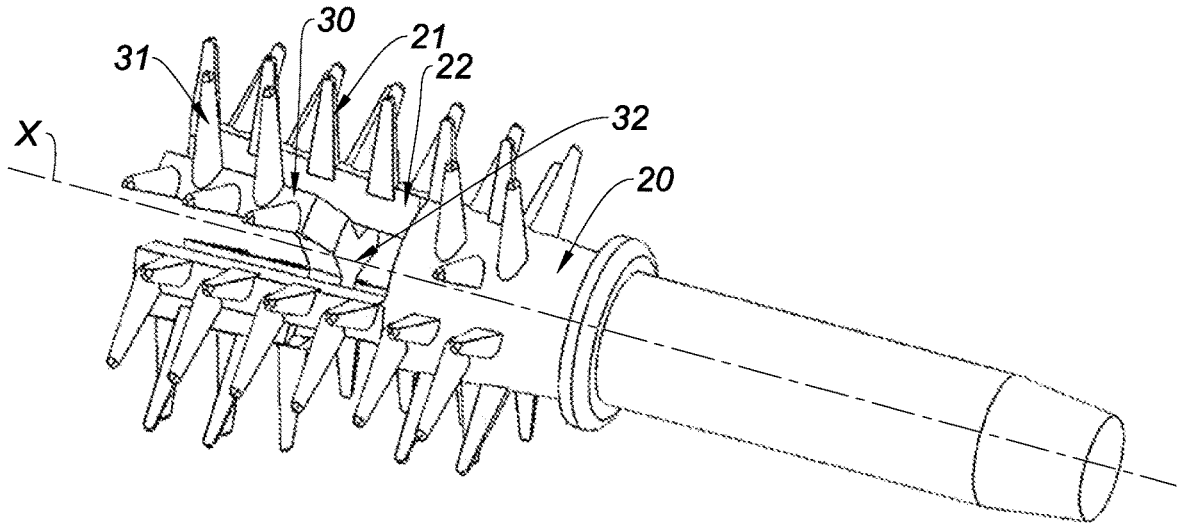
FIG. 2 is an isometric view of the same embodiment as that shown in FIG. 1, which is tilted and cut so as to show in particular the proximal end of the applicator.
Figure 3:
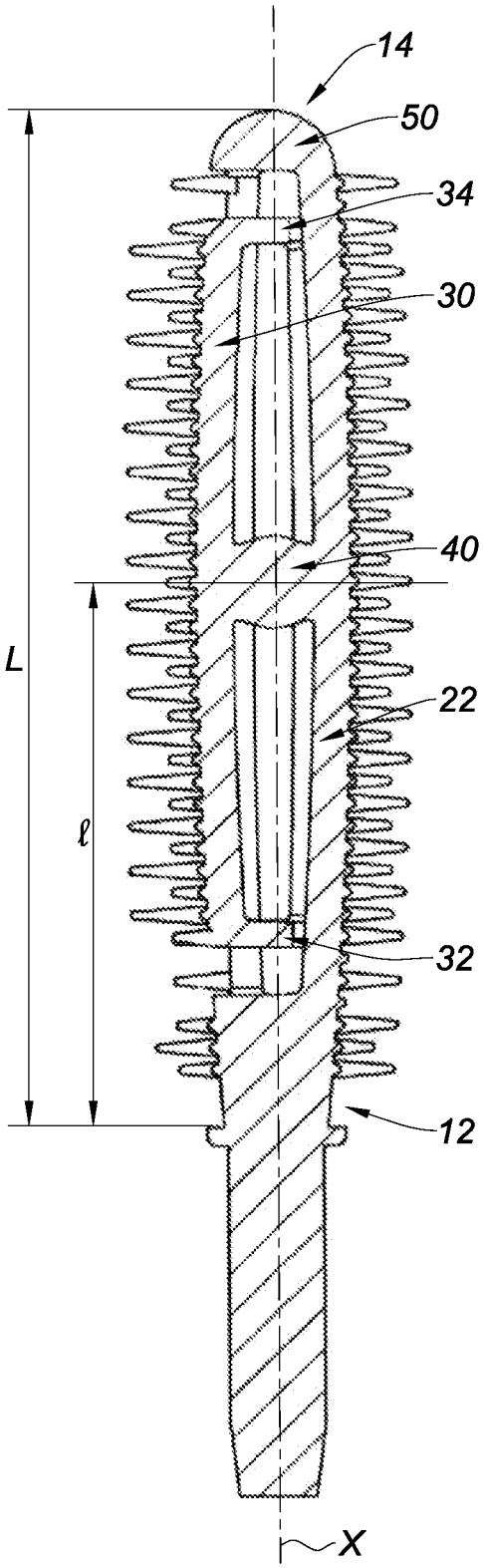
FIG. 3 is a cross-sectional view of the same embodiment as that shown in FIGS. 1 and 2.

According to the first embodiment shown by FIGS. 1 to 3, the branches 30 are interconnected by means of reinforcing elements, referred to as plates 32, 34, which are oriented substantially transversely to the main direction X. In this case, there are two of the plates 32, 34, each positioned in the vicinity of one of the proximal 12 and distal 14 ends of the applicator.

It is of interest to note that the plates 32, 34 are designed so as not to hit the link arms 22 when the flexibility of at least one of the branches 30 is activated by an element outside the applicator 10. For this purpose, the plates 32, 34 are in the shape of a cross.

Figure 5:
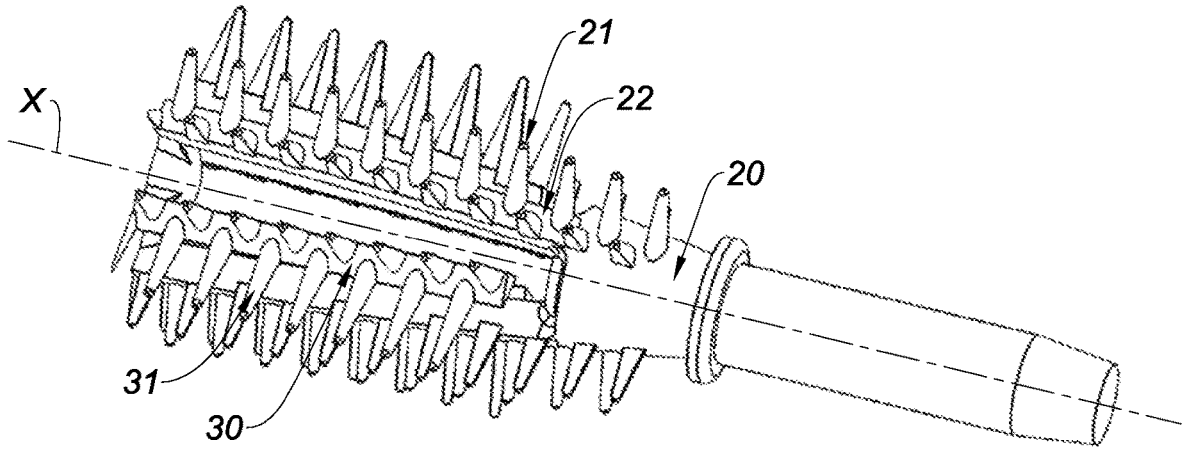
FIG. 5 is an isometric view of the same embodiment as that shown in FIG. 4, which is tilted and cut so as to show in particular the proximal end of the applicator.
Figure 6:
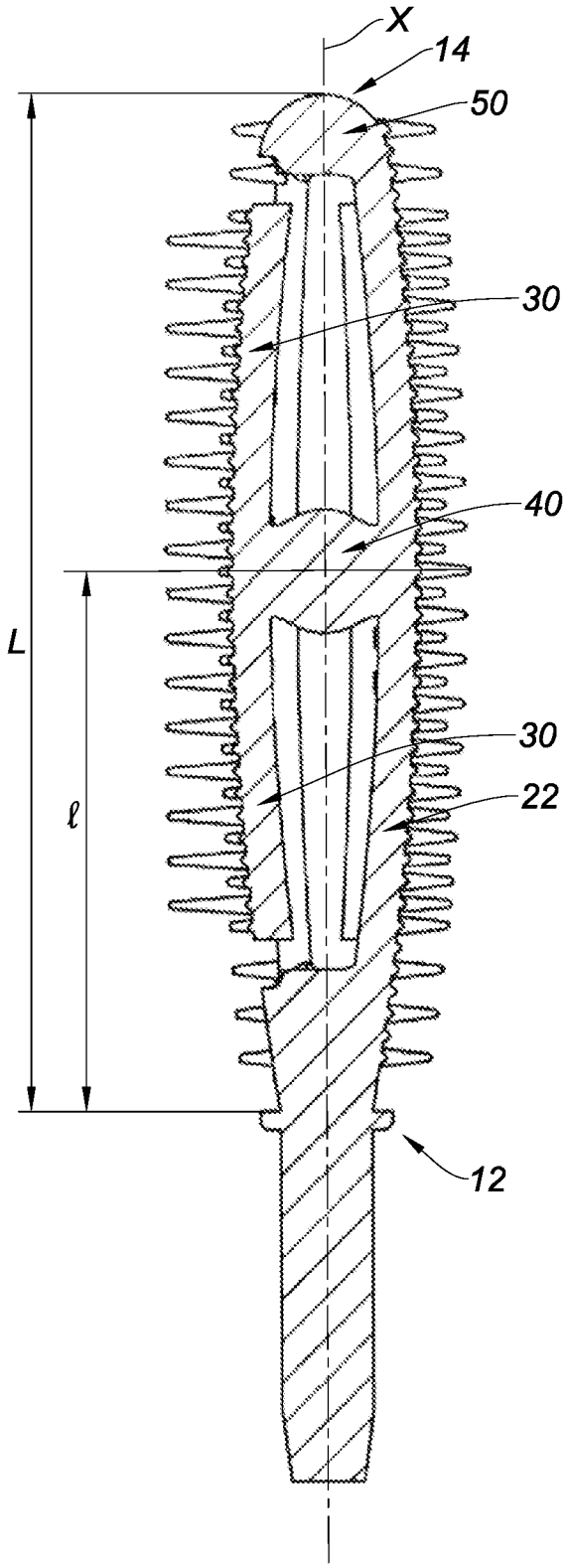
FIG. 6 is a cross-sectional view of the same embodiment as that shown in FIGS. 4 and 5.

According to the second embodiment shown by FIGS. 4 to 6, the branches 30 are free of any reinforcing elements. In other words, the branches 30 are connected solely to the articulation 40, they are not connected to one another.

This has the advantage of freeing each of them slightly more, in particular in comparison with the first embodiment in which the branches are rigidly connected in the flexibility thereof.

According to a third embodiment, shown by FIGS. 7 to 14, the support 20 will advantageously be produced in the form of a solid core. In the context of this third embodiment, the articulation 40 is a protuberance of material supported at the end of the support 20. In other words, the articulation 40 forms an end of the support 20, in the main direction X (see also FIGS. 10 and 11).

In the context of this third embodiment, the applicator 10 of the invention further includes a plurality of branches 30 all connected to the articulation 40. In other words, the branches 30 are not interconnected.

More specifically, in the context of this embodiment, it is the branches 30 which form the applicator 10 of the invention by each extending between the proximal 12 and distal 14 ends of the applicator 10, over the majority of the length L.

In other words, the support 20 and the branches 30 each extend in their own direction which is collinear with the main direction X. In other words again, the branches 30 each extend in a direction which is distinct from the support 20 and from the branch 30 which is directly adjacent thereto.

In a first variant of this third embodiment, the applicator 10 of the invention includes a number of branches 30 which is between 4 and 10, the branches 30 each extending between the proximal 12 and distal 14 ends of the applicator 10. This first variant is shown by FIGS. 7 to 11, and in this case has six branches 30.

Figure 12:
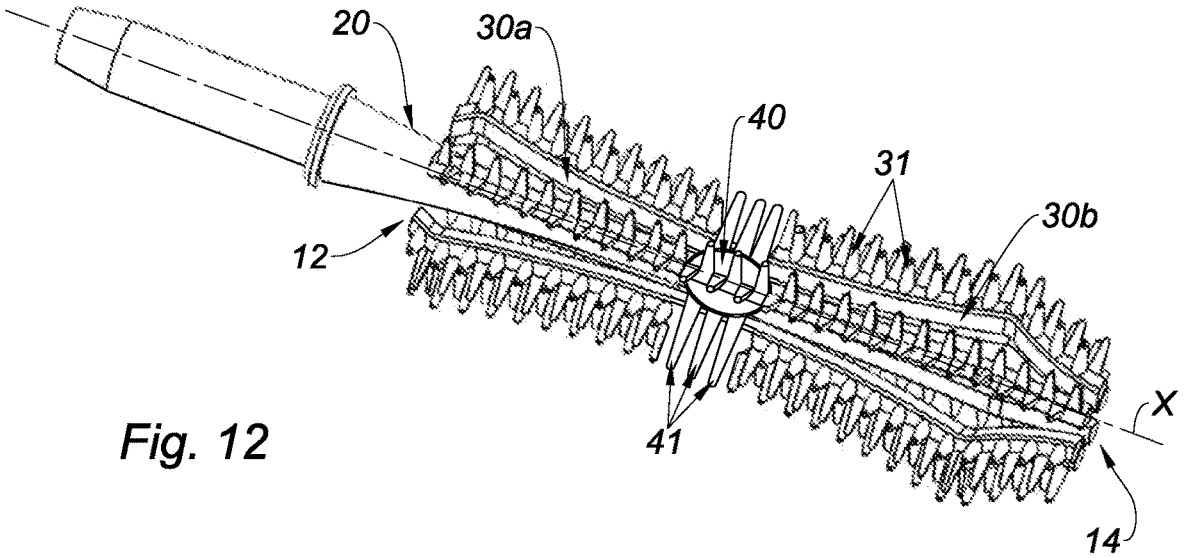
FIGS. 12, 13 and 14 show variants of the third embodiment.
Figure 13:
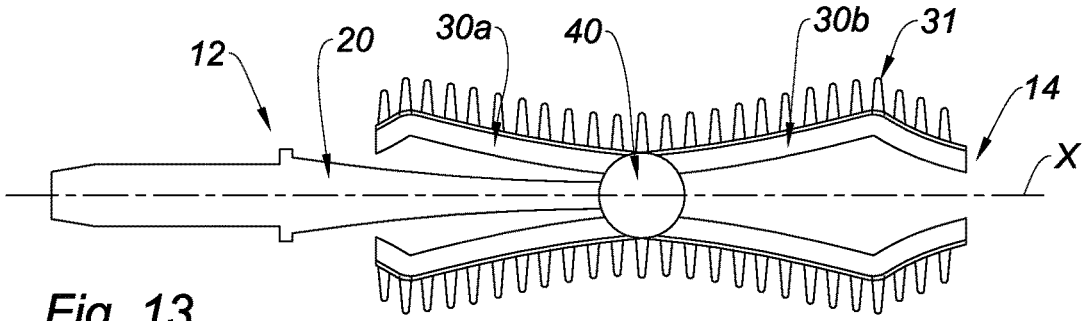
Figure 14:
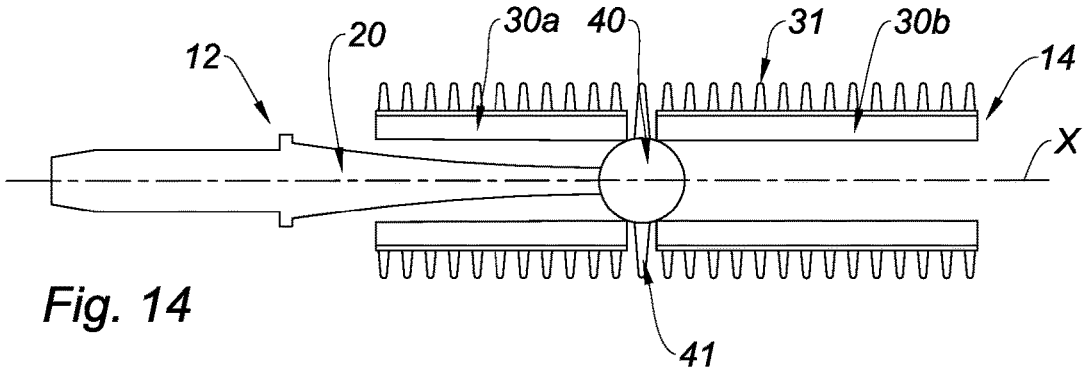

In a second and third variant, shown by FIGS. 12 to 14, the applicator 10 of the invention includes a number of branches 30*a*, 30*b* which is between 8 and 20, the branches 30*a*, 30*b* each extending in the main direction X, between the articulation 40, on the one hand, and one or the other of the proximal 12 or distal 14 ends, on the other hand. In other words, the applicator 10 includes branches 30*a*, 30*b* which begin in the region of the articulation 40 and which are oriented towards the proximal end 12, on the one hand (denoted by reference numeral 30*a* in FIG. 12 to 14) or towards the distal end 14, on the other hand (denoted by reference numeral 30*b* in the same drawings).

In the context of this third embodiment, regardless of the selected variant, the applicator 10 of the invention will advantageously include a plurality of protrusions 31 which project from each of the branches 30, 30*a*, 30*b*, in the form of rows of protrusions arranged along the main direction X. The protrusions 31 will advantageously project on both sides of a plane which is substantially orthogonal to the main direction X. The protrusions 31 will form on each of the branches 30, 30*a*, 30*b*, a row of teeth distributed in staggered rows, on both sides of the plane which is substantially orthogonal to the main direction X.

It is of interest to note that, in the context of the second and third variants, the articulation 40 itself can include protrusions 41; the protrusions will be oriented in the form of rows as has just been described. The protrusions can also be isolated, in particular in a plane which is orthogonal to the main direction X (see FIGS. 12, 13 and 14).

Regardless of the embodiment described, the connection region between the branches 30, 30*a*, 30*b* and the articulation 40 will advantageously be a discrete contact region between the outer periphery of the articulation 40 and the branches 30.

Regardless of the embodiment described, the branches 30 extend in their own direction which is collinear with the main direction X and which is distinct from the main direction X.

Regardless of the embodiment described, the main direction X passes through the articulation 40; the articulation 40 being, itself, located at a distance from at least one of the two, proximal/distal ends of the branch 30/the branches 30 which begin thereon.

Regardless of the embodiment described, the branch 30/the branches 30 which are in contact with the articulation 40 project from the articulation 40, forming an angle which is substantially zero with the main direction X.

Thus, the contact between the branches 30 and the articulation allows any flexibility of the branches 30, 30*a*, 30*b* of the applicator according to the invention 10, in particular in more than one direction from the orthonormal reference point (X, Y, Z).

As mentioned above, this is understood to mean a flexibility of the branches 30, 30*a*, 30*b* when an external element disrupts the balance of the branches 30, 30*a*, 30*b*, in particular by brushing against the branches 30, 30*a*, 30*b*. Unexpected effects in terms of make-up application are thus obtained with the applicator 10 of the invention, in particular when the applicator is loaded with cosmetic product and brushes against a user's eyelashes. In fact, the branches 30, 30*a*, 30*b* which are flexible, in a plurality of directions, come into contact with the eyelashes, as close as possible thereto.

Secondly, the advantage associated with an applicator 10, such as that of the invention, regardless of the embodiment, also lies in the ability to provide the applicator with protrusions 21, 31, the radial extensions of which are relatively short. "Radial extension" is understood to mean the height of a protrusion 21, 31 measured from the branches 30, 30*a*, 30*b* of the link arm 22/from the branch 30 from which the protrusion projects, in the direction of the free end thereof.

Relatively short protrusions 21, 31 have a known loading ability. In this case, the protrusions further have a significant flexibility, thus an advantageous combing ability.

For example, the protrusions 21, 31 will have a radial extension of between 1.5 and 3 mm, preferably of approximately 2 mm. The applicator 10 itself will form a brush, the external envelope of which, outlined by the free ends of the protrusions 21, 31, will be entrenched in a cylinder, the height of which is taken together with the main direction X, and the diameter of which will be, for example, between 7 and 9 mm, preferably between 7.5 and 8.5 mm. Thus, the applicator 10 of the invention includes protrusions 21, 31, the radial extension of which is less than that which is usually formed, for a brush formed by the free ends of the protrusions 21, 31 which, itself, is within the standard dimensions usually encountered in the context of such a brush.

It should be noted that the arrangement of the protrusions 21, 31, in staggered rows and in longitudinal rows, as mentioned above, has the advantage of satisfactorily retaining the cosmetic product therebetween, to then deliver the product onto a user's eyelashes.

The invention also relates to an applicator assembly comprising an applicator 10 of the type described above. The assembly further includes a bottle which is intended to receive a cosmetic product, the assembly being intended to occupy two positions, a first position, referred to as the position of use, in which a user can apply make-up with the applicator 10, and a second position, referred to as the rest position, in which the applicator 10 is positioned inside the bottle, the assembly further comprising a wiper which is intended to be assembled with the bottle so as to wipe the applicator during the passage thereof from the rest position to the position of use.

The bottle and the wiper are not shown here.

In the context of the first and the second embodiments, the applicator 10 of the invention will further include, in the vicinity of the distal end 14 thereof, a protection region 50 which is formed integrally with the support 20 (see FIGS. 1, 3, 4 and 6). The protection region 50 is advantageously designed so as to avoid any removal of the branches 30 during the passage of the applicator assembly from the position of use to the rest position.

In other words, during the passage of the applicator assembly from the position of use to the rest position, the protection region 50, provided in this case in the form of half a ball, will act as a bumper and will absorb the forces which could lead to undesirable tilting of the branches 30. The protection region 50 can also be provided in another form, for example in the form of a truncated pyramid, without departing from the scope of the invention.

In the context of the third embodiment, the protection of the branches 30 will be obtained by the intrinsic design thereof. In fact, the branches 30 will advantageously be designed so as to converge in the main direction X when in contact with the wiper, so as to avoid any removal of the branches 30 during the passage of the applicator assembly from the position of use to the rest position and/or from the rest position to the position of use.

In fact, the branches will each have two regions Z12, Z14 in the vicinity of the proximal end 12 and of the distal end 14 respectively. It is these two regions Z12, Z14 which make it possible to make the branches 30 converge in the main direction X when they come into contact with a wiper (see FIGS. 8 and 11).

In zone Z12, in the vicinity of the proximal end 12, the branches have a technical shape which is sloped, and the rise of which decreases towards the proximal end of the applicator 10, which makes it possible to ensure the convergence of the branches 30 towards the main direction X when the branches 30 come into contact with a wiper, in particular during the passage of the applicator assembly from the rest position to the position of use.

Secondly, each of the branches 30 also has, in the region Z14, a technical shape which is sloped, and the rise of which decreases towards the distal end 14 of the applicator 10, which makes it possible to ensure the convergence thereof towards the main direction X during the passage of the applicator assembly from the position of use to the rest position.

It is of interest to note that the details of the embodiments and variants described above can be combined without departing from the scope of the invention, in particular in order to obtain complementary effects for applying make-up to a user's eyelashes.

It should also be noted that the support 20, the branches 30, and the articulation 40 will advantageously be moulded from the same material, thus integrally, for example from an LDPE (low-density polyethylene)-based plastics material. Other materials can also be used, namely the material "EXACT" from ExxonMobil or the material "HYTREL" from Dupont, or a mixture of the materials.

Thus, the applicator 10 of the invention can be obtained through a known moulding operation, for example by injection moulding plastics material.

In other words, the original design of the applicator 10 of the invention makes it possible, with a conventional moulding process, to obtain a particularly precise application of make-up to a user's eyelashes. In fact, the protrusions 31 supported by a movable branch 31 come into contact with the user's fringe of eyelashes, whilst adapting to the morphology thereof. The applicator 10 of the invention thus proposes a design which is suitable for a wide range of users, in particular due to the movability of the branches 30 on the articulation 40.

It should also be noted that the applicator of the invention includes a portion which extends from the proximal end 12 of the applicator 10, in the main direction X, in the form of a cylindrical coupling which is intended to be fixed in/to a holding rod. The holding rod, not shown here, is usually rigidly connected to a cap which acts as a cover for the bottle introduced at the beginning of the present description.

It should also be noted that variants are of course possible. In particular, in an embodiment not shown here, the articulation 40 can be provided in the vicinity of the proximal end 12 with integrally formed branches 30, which extend in the main direction, towards the distal end 14, the branches being independent of one another.

The invention claimed is:

1. An applicator for cosmetic product extending in a main direction, between a proximal end and a distal end opposite the proximal end in said main direction, said applicator comprising:

a structural support and at least one branch, said support and said at least one branch being interconnected by an articulation rigidly connected to said support, and, a plurality of protrusions projecting from said at least one branch, wherein said support and said at least one branch extend in said main direction, wherein the at least one branch and the articulation are in contact in a connection region between the at least one branch and the articulation, the connection region being a discrete contact region between an outer periphery of the articulation and the at least one branch, and wherein said at least one branch has two ends, a proximal and a distal end, both of which are allowed free movement, and said support, said at least one branch, and said articulation allow a flexibility of the at least one branch in more than one direction from a reference point (X,Y,Z) of said applicator so as to carry out a movement which is visible at the proximal and distal ends of the branch.

2. The applicator according to claim 1, wherein said articulation is produced from material of the support.

3. The applicator according to claim 2, wherein said articulation is located in said main direction, between the proximal and distal ends of said applicator.

4. The applicator according to claim 3, wherein the proximal and distal ends of said applicator are remote by a length L, said articulation being remote by a length l with respect to the proximal end of said applicator, said lengths L and l being measured in said main direction, said lengths complying with the ratio $0.25 \leq l/L \leq 0.75$.

5. The applicator according to claim 1, wherein the support is produced in a form of a hollow arch formed by a plurality of arms which connect the proximal and distal ends of said applicator, said plurality of arms being link arms, the articulation being supported by said link arms.

6. The applicator according to claim 5, wherein the plurality of arms comprises three link arms which alternate around the main direction with three branches of said at least one branch all being connected to said articulation.

7. The applicator according to the claim 6, further comprising a plurality of protrusions which project from each of the link arms, the pluralities of protrusions project from each of the link arms and each of the branches in the form of rows of protrusions arranged along said main direction.

8. An applicator assembly comprising:

an applicator for cosmetic product extending in a main direction, between a proximal end and a distal end opposite said proximal end in said main direction, the applicator comprising:

a structural support and at least one branch, said support and said at least one branch being interconnected by an articulation rigidly connected to said support, and, a plurality of protrusions projecting from said at least one branch, wherein said support and said at least one branch extends in said main direction, wherein the at least one branch and the articulation are in contact in a connection region between the at least one branch and the articulation, the connection region being a discrete contact region between an outer periphery of the articulation and the at least one branch, and wherein said at least one branch has two ends, a proximal and a distal end, both of which are allowed free movement, and said support, said at least one branch, and said articulation allow a flexibility of the at least one branch in more than one direction from a reference point (X,Y,Z) of said applicator so as to carry out a movement which is visible at the proximal and distal ends of the branch;

a bottle receiving a cosmetic product, said assembly occupying two positions comprising a first position of use in which a user can apply make-up with said applicator, and a second rest position, in which said applicator is positioned inside the bottle, a wiper assembled with said bottle so as to wipe said applicator during passage thereof from the rest position to the position of use, and, a protection region in a vicinity of the distal end formed integrally with the support, said protection region avoiding any removal of said at least one branch during the passage of the applicator assembly from the position of use to the rest position.

* * * * *